United States Patent [19]

Merrick et al.

[11] 4,359,349

[45] Nov. 16, 1982

[54] METHOD FOR HEAT TREATING IRON-NICKEL-CHROMIUM ALLOY

[75] Inventors: Howard F. Merrick, Suffern, N.Y.; Michael K. Korenko, Rockville, Md.

[73] Assignee: The United States of America as represented by the United States Department of Energy, Washington, D.C.

[21] Appl. No.: 137,049

[22] Filed: Apr. 3, 1980

Related U.S. Application Data

[63] Continuation-in-part of Ser. No. 61,229, Jul. 27, 1979, abandoned.

[51] Int. Cl.[3] ..... C21D 7/14

[52] U.S. Cl. ..... 148/12.3; 148/12.7 R; 148/12.7 N; 148/31; 148/405

[58] Field of Search ..... 148/11.5 N, 12.7 N, 148/12.7 R, 12.3, 31, 32.5; 75/171, 128 T, 122, 134 F, 124

[56] References Cited

U.S. PATENT DOCUMENTS 3,046,108 7/1962 Eiselstein ..... 75/171

4,236,943 12/1980 Korenko et al. ..... 75/171

OTHER PUBLICATIONS

Nimonic Alloy PE16, Publication 3349A, Jan., 1968, pp. 1–28, Henry Wiggin and Company Limited, Hereford, England.

*Primary Examiner*—R. Dean

*Attorney, Agent, or Firm*—J. J. Prizzi

[57] ABSTRACT

A method for heat treating an age-hardenable iron-nickel-chromium alloy to obtain a bimodal distribution of gamma prime phase within a network of dislocations, the alloy consisting essentially of about 25% to 45% nickel, 10% to 16% chromium, 1.5% to 3% of an element selected from the group consisting of molybdenum and niobium, about 2% titanium, about 3% aluminum, and the remainder substantially all iron. To obtain optimum results, the alloy is heated to a temperature of 1025° C. to 1075° C. for 2–5 minutes, cold-worked about 20% to 60%, aged at a temperature of about 775° C. for 8 hours followed by an air-cool, and then heated to a temperature in the range of 650° C. to 700° C. for 2 hours followed by an air-cool.

11 Claims, 1 Drawing Figure

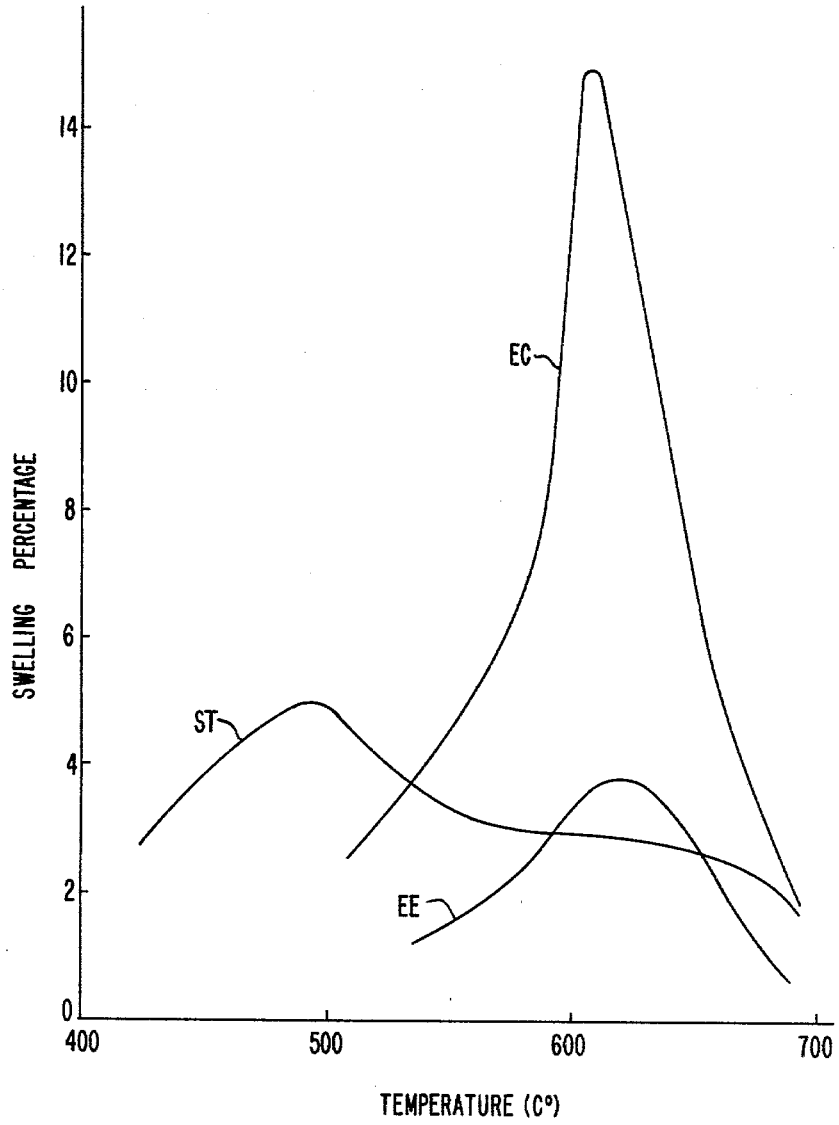
SWELLING PERCENTAGE
0
2
4
6
8
10
12
14
400
500
600
700
TEMPERATURE (C°)
EC
ST
EE

METHOD FOR HEAT TREATING IRON-NICKEL-CHROMIUM ALLOY

GOVERNMENT CONTRACT STATEMENT

The present invention was made or conceived during the performance of work under Contract No. EY-76-C-14-2170 with the Department of Energy.

CROSS-REFERENCE TO RELATED APPLICATIONS

This is a Continuation-in-Part of Application Ser. No. 061,229, filed July 27, 1979 abandoned.

BACKGROUND OF THE INVENTION

The present invention is particularly adapted for use with a nickel-chromium-iron alloy such as that described in copending application Ser. No. 917,832, filed June 22, 1978, now U.S. Pat. No. 4,236,943 issued on Dec. 2, 1980, which has strong mechanical properties and, at the same time, has swelling resistance under the influence of irradiation and low neutron absorbence. As such, it is particularly adapted for use as a ducting and cladding alloy for fast breeder reactors.

A material of this type is a gamma-prime strengthened superalloy; and its properties can be altered drastically by varying the thermomechanical treatment to which it is subjected. For nuclear reactor applications it is, of course, desirable to subject the alloy to a thermomechanical treatment which will produce the greatest irradiation-induced swelling resistance and/or the highest strength and most importantly the highest post irradiation ductility.

SUMMARY OF THE INVENTION

In accordance with the present invention, an alloy having a composition of about 25% to 45% nickel, 10% to 16% chromium, 1.5% to 3% of an element selected from the group consisting of molybdenum and niobium, about 1% to 3% titanium, about 0.5% to 3.0% aluminum and the remainder substantially all iron, is initially heated to a temperature in the range of about 1000° C. to 1100° C. for a period of 30 seconds to one hour; although the preferred heat treatment is to heat in the range of 1025° C. to 1075° C. for 2–5 minutes to minimize the time in the furnace. This initial heat treatment is followed by a furnace-cool and cold-working in the range of about 20% to 60% although cold working within the range between 10% and 80% is useful. Thereafter, the alloy is heated to a temperature in the range of 750° C. to 825° C. for 4–15 hours and preferably 775° C. for 8 hours, followed by an air-cool. Thereafter, the alloy is again heated to a temperature in the range of about 650° C. to 700° C. for 2–20 hours followed by an air-cool.

The above and other objects and features of the invention will become apparent from the following detailed description taken in connection with the accompanying drawing which is a plot of percent swelling versus annealing temperature for an alloy within the scope of the invention.

In order to establish the desirable results of the invention, an alloy having the following composition was subject to various thermomechanical treatments hereinafter described:

TABLE I

| | |
|---|---|
| Nickel | 45% |
| Chromium | 12% |
| Molybdenum | 3% |
| Silicon | 0.5% |
| Zirconium | 0.05% |
| Titanium | 2.5% |
| Aluminum | 2.5% |
| Carbon | 0.03% |
| Boron | 0.005% |
| Iron | Bal. |

The foregoing alloy is a gamma-prime strengthened superalloy. Its properties can be altered drastically by varying its thermomechanical treatment prior to testing. The following Table II sets forth the various thermomechanical treatments to which the alloy set forth in Table I was subjected; while Table III lists the resulting microstructural and mechanical properties of the alloy after heat treatment:

TABLE II

| Designation | Thermomechanical Treatment |
|---|---|
| AR | 1038° C./1 hr/FC + 60% CW |
| IN-1 | *982° C./1 hr/AC + 788° C./1 hr/AC + 720° C./24 hr/AC |
| IN-2 | *890° C./1 hr/AC + 800° C./11 hr/AC + 700° C./2 hr/AC |
| EC | *927° C./1 hr/AC + 800° C./11 hr/AC + 700° C./2 hr/AC |
| EE | *800° C./11 hr/AC + 700° C./2 hr/AC |

*After 1038° C./1 hr/FC + 60% CW.

TABLE III

| Designation | Comments | 650° C. UTS (ksi) | 650° C. 80 ksi SR (hr) |
|---|---|---|---|
| AR | No gamma-prime, high dislocation density | — | 67.9 |
| IN-1 | Bimodel gamma-prime, recrystallized above gamma-prime solvus | 151.5 | 0.8 |
| IN-2 | Trimodal gamma-prime (Dislocated) | 141.3 | 81.9 |
| EC | Trimodal gamma-prime recrystallized below gamma-prime solvus | — | 64.7 |
| EE | Bimodal gamma-prime, equiaxed cells | — | 235 |

As can be seen from Table III above, the EC treatment produces higher stress rupture properties than treatment IN-1. The EC treatment results in a trimodal distribution of gamma-prime since the recrystallization anneal is below the gamma-prime solvus and results in the precipitation of a small volume of large (approximately 600 nm) gamma-prime precipitates.

Of the treatments set forth in Tables II and III, three treatments produced dislocated structures. These are treatments AR, IN-2 and EE. The stress rupture data of Table II reveals that heat treatment EE produces a significantly stronger material. This structure consists of an interwoven dislocated cell structure which is pinned by a bimodal gamma-prime distribution. This condition has the highest strength of any tested and is very stable because of the pinned nature of the dislocation cells.

The graph shown in the attached figure illustrates the swelling behavior of the alloy set forth in Table I in three thermomechanical conditions, ST, EC and EE. The swelling versus temperature curves are for radiation doses of 30 $dpa_e$, which is equivalent to 203 MWd/MT (i.e., greater than the goal fluence of 120 MWd/MT). The data reveals that the ST and EE treatments produce the lowest swelling in the alloy set forth in Table II above. The EC treatment produces an acceptable level of swelling at goal fluences but the treatment is far from optimum for in-reactor applications.

In similar tests, an alloy having the following composition was tested:

TABLE IV

| | |
|---|---|
| Nickel | 60 |
| Chromium | 15 |
| Molybdenum | 5.0 |
| Niobium | 1.5 |
| Silicon | 0.5 |
| Zirconium | .03 |
| Titanium | 1.5 |
| Aluminum | 1.5 |
| Carbon | 0.03 |
| Boron | 0.01 |
| Iron | Bal. |

The thermomechanical treatments given to the aforesaid alloy of Table IV and the microstructures and mechanical properties of the resulting alloy are given in the following Tables V and VI:

TABLE V

| Designation | Thermomechanical Treatment* |
|---|---|
| BP | 1038° C./1 hr/AC + 800 C/11 hr/AC + 700° C./2 hr/AC |
| BR | 927° C./1 hr/AC + 800° C./11 hr/AC + 700° C./2 hr/AC |
| BT | 1038° C./0.25 hr/AC + 899° C./1 hr/AC + 749° C./8 hr/AC |
| CT | 30% WW at 1038° C. + 800° C./11 hr/AC + 700° C./2 hr/AC |
| CU | 890° C./1 hr/AC + 800° C./11 hr/AC + 700° C./2 hr/AC + 30 |
| BU | 800° C./11 hr/AC + 700° C./2 hr/AC |

*After 1038° C./1 hr/FC + 60% CW.

TABLE VI

| Designation | Comments | 650° C. UTS (ksi) | 650° C. 80 ksi SR (hr) |
|---|---|---|---|
| BP | Small gamma-prime, no dislocations | 136.7 | — |
| BR | Bimodal gamma-prime, gamma cells | 152.5 | 73 |
| BT | Bimodal gamma-prime no dislocations | 135.3 | — |
| CT | Bimodal gamma-prime, non-uniform structure (long banded cells, some subgrains) | 154.6 | — |
| CU | Bimodal gamma-prime, elongated cells | 147.0 | — |
| BU | Bimodal gamma-prime, equiaxed cells | 156.4 | 74 |

The gamma-prime solvus and the one hour recrystallization temperature for the alloy set forth in Table IV are 915° C. ±10° C. and 1000° C±20° C., respectively. Therefore, unlike the alloy given in Table I, there is no temperature range in which recrystallization can be accomplished while aging. Consistent with this fact, treatments BP and BT which involve annealing at 1038° C. and subsequent double-aging, both produce a dislocation-free austenite matrix and a bimodal gamma-prime distribution. Structures produced by treatments CU and BU, which do not induce recrystallization, all contain a highly dislocated cell structure containing various distributions of gamma-prime.

Table VI is a summary of the observed structures and corresponding physical properties. Note that the mechanical property values are grouped into two classes. These are non-dislocation density, gamma-prime containing structures having 650° C., ultimate tensile strengths between 135 and 137 ksi, and the dislocated gamma-prime structures, which are much stronger, with ultimate tensile strengths between 147 and 157 ksi. Because of their superior strength and because of the benefit of an increased incubation time for swelling, dislocated structures are preferred.

Treatment CU set forth in Tables V and VI above, starts with a dislocated cell structure with a trimodal gamma-prime distribution which is subsequently cold-worked 30%. The final cold-working operation actually decreases the strength as indicated by the 650° C. ultimate tensile strength data set form in Table VI, apparently by destroying the integrity of the dislocation cell walls.

Treatments BR and BU of the alloy set forth in Table IV both produce a highly dislocated, partially recrystallized or recovered cell structure with bimodal gamma-prime size distribution. The BU treatment is preferred since it yields slightly higher stress rupture properties than the BR treatment. The dislocation and gamma-prime structures for the BU treatment produce a cell structure which is much more dispersed and interwoven than that produced by the EE treatment of the alloy set forth in Table I. The minimum cell thickness of the BU treatment is approximately the same as the gamma-prime particle spacing.

In order to further demonstrate the improvement that is obtained by means of the thermomechanical treatment of the present invention, reference may be had to the following Tables VII and VIII which shows that this treatment is very effective in promoting high post radiation ductility. In this regard it should be pointed out that there exists a trough in which the ductility of these materials is materially decreased when tested at a temperature which is 110° C. above the temperature at which the material has been irradiated. Thus, the poorest ductility would be found at a temperature of 805° C. where the material has been irradiated at 695° C. This 110° should account for all transient conditions of operation of for example a fast breeder reactor. Thus the selection of the material and the heat treatment or the thermomechanical heat treatment of the material which when irradiated at 695° centrigrade should be tested at 805° C. where the lowest post irradiation ductility has occurred. Reference to the following Tables VII and VIII make it abundantly clear for example that the solution treated condition of alloy D66 when irradiated at 695° C. and tested at 805° C. exhibits zero ductility. In contrast thereto, material which has been subjected to the treatment set forth in the claims appended hereto of the same alloy irradiated at 695° C. and tested at 805° C. shows that a 1.1% uniform elongation is available. It is critically important to maintain a greater than 0.3% ductility under these conditions since this is necessary to maintain fuel pin integrity during reactor transient conditions and the tables demonstrate the attainment of those goals. Tables VII and VIII also illustrate that the higher ductility of this treatment is also accompanied by higher strength which is a highly unexpected as respects these irradiated materials. These higher strengths also attest to the fact of the excellent swelling resistance demonstrated by the alloys which are subjected to the method of this treatment.

TABLE VII

TENSILE PROPERTIES OF NEUTRON IRRADIATED DEVELOPMENTAL ALLOY D66-SOLUTION TREATED

| Specimen No. | Irradiation Temp. (°C.) | Test Temp. (°C.) | Strain Rate ($sec^{-1}$) | Proportional Elastic Limit (MPa) | Proportional Elastic Limit (ksi) | Yield Stress (MPa) | Yield Stress (ksi) | Ultimate Tensile Stress (MPa) | Ultimate Tensile Stress (ksi) | Uniform Elongation (%) | Total Elongation (%) | |
|---|---|---|---|---|---|---|---|---|---|---|---|---|
| | | | | | | D66 SA | | | | | | |
| Nominal Fluence = $4 \times 10^{22}$n-cm$^{-2}$ (E > 0.1 MeV) | | | | | | | | | | | | |
| BR-03 | 695 | 232 | $4 \times 10^{-4}$ | 819.2 | 118.8 | 905.3 | 131.3 | 1236.9 | 179.4 | 9.0 | 9.0 | |
| BR-76 | 735 | 232 | $4 \times 10^{-4}$ | 848.6 | 120.3 | 927.3 | 134.5 | 1291.4 | 187.3 | 9.0 | 9.0 | |
| BR-26 | 500 | 500 | $4 \times 10^{-4}$ | 899.2 | 130.4 | 996.4 | 144.5 | 1152.9 | 167.2 | 7.0 | 7.6 | |
| BR-29 | 600 | 600 | $4 \times 10^{-4}$ | 815.5 | 118.3 | 953.0 | 138.2 | 1078.5 | 156.4 | 2.6 | 3.3 | |
| BR-19 | 695 | 695 | $4 \times 10^{-4}$ | 775.6 | 112.5 | 850.1 | 123.8 | 879.1 | 127.5 | 1.3 | 1.3 | |
| BR-32 | 735 | 735 | $4 \times 10^{-4}$ | 701.1 | 101.7 | | | 746.0 | 108.2 | 0.15 | 0.15 | |
| BR-28 | 735 | 735 | $4 \times 10^{-4}$ | 565.5 | 82.0 | 682.6 | 99.0 | 682.5 | 99.0 | 0.18 | 0.18 | |
| BR-23 | 500 | 610 | $4 \times 10^{-4}$ | 751.8 | 109.0 | | | 910.2 | 132.0 | 0.13 | 0.13 | |
| BR-41 | 695 | 805 | $4 \times 10^{-4}$ | 237.3 | 34.4 | | | | | | | |
| BR-51 | 695 | 805 | $4 \times 10^{-4}$ | 464.8 | 67.4 | | | 448.2 | 65.0 | 0 | 0 | |
| | | | | | | Special Test | | | | | | |
| BR-79 | 500 | 232 | $4 \times 10^{-4}$ | 908.1 | 131.7 | 1048.6 | 152.1 | 1161.0 | 168.3 | 2.2 | 2.2 | Interrupted |
| | | 610 | $4 \times 10^{-4}$ | | | | | 973.7 | 141.22 | 0.03 | 0.03 | Test |

TABLE VIII

TENSILE PROPERTIES OF NEUTRON IRRADIATED DEVELOPMENTAL ALLOY D66-EE

| Specimen No. | Irradiation Temp. (°C.) | Test Temp. (°C.) | Strain Rate ($sec^{-1}$) | Proportional Elastic Limit (MPa) | Proportional Elastic Limit (ksi) | Yield Stress (MPa) | Yield Stress (ksi) | Utimate Tensile Stress (MPa) | Utimate Tensile Stress (ksi) | Uniform Elongation (%) | Total Elongation (%) |
|---|---|---|---|---|---|---|---|---|---|---|---|
| | | | | | | D66 EE | | | | | |
| Nominal Fluence = $4 \times 10^{22}$n-cm$^{-2}$(E > 0.1 MeV) | | | | | | | | | | | |
| BT-50 | 450 | 232 | $4 \times 10^{-4}$ | 295.3 | 187.9 | 1474.0 | 213.8 | 1721.6 | 249.7 | 4.5 | 4.8 |
| BT-49 | 695 | 232 | $4 \times 10^{-4}$ | 1108.7 | 160.8 | 1187.3 | 172.2 | 1441.0 | 209.0 | 4.8 | 4.8 |
| BT-30 | 735 | 232 | $4 \times 10^{-4}$ | 1035.8 | 150.2 | 1114.1 | 161.6 | 1385.8 | 201.0 | 5.7 | 5.7 |
| BT-42 | 450 | 450 | $4 \times 10^{-4}$ | 1134.8 | 164.5 | 1250.8 | 181.4 | 1418.4 | 205.7 | 2.8 | 3.6 |
| BT-47 | 500 | 500 | $4 \times 10^{-4}$ | 1052.9 | 152.7 | 1178.4 | 170.9 | 1379.1 | 200.0 | 3.1 | 3.2 |
| BT-61 | 550 | 550 | $4 \times 10^{-4}$ | 926.5 | 134.4 | 1163.3 | 168.7 | 1369.4 | 198.6 | 4.1 | 4.1 |
| BT-41 | 600 | 600 | $4 \times 10^{-4}$ | 916.5 | 132.9 | 111.5 | 161.2 | 1312.6 | 180.2 | 3.4 | 5.3 |
| BT-26 | 695 | 695 | $4 \times 10^{-4}$ | 672.7 | 97.6 | 789.4 | 114.5 | 909.4 | 131.9 | 2.8 | 6.3 |
| BT-43 | 735 | 735 | $4 \times 10^{-4}$ | 538.7 | 78.1 | 616.4 | 89.4 | 714.3 | 103.6 | 2.3 | 3.5 |
| BT-21 | 450 | 560 | $4 \times 10^{-4}$ | 899.6 | 130.5 | 1198.3 | 173.8 | 1297.0 | 188.1 | 1.15 | 1.2 |
| BT-35 | 500 | 610 | $4 \times 10^{-4}$ | 866.5 | 125.7 | 1122.6 | 162.8 | 1220.5 | 177.0 | 1.4 | 1.7 |
| BT-00 | 550 | 650 | $4 \times 10^{-4}$ | 770.8 | 113.1 | 963.3 | 139.7 | 1038.5 | 150.6 | 1.6 | 2.8 |
| BT-18 | 600 | 710 | $4 \times 10^{-4}$ | 536.6 | 77.8 | 704.0 | 102.1 | 784.7 | 113.8 | 1.7 | 2.0 |
| BT-48 | 695 | 805 | $4 \times 10^{-4}$ | 339.4 | 49.2 | 455.1 | 66.0 | 504.0 | 73.1 | 1.11 | 2.2 |
| | | | | | | Special Tests D66-EE | | | | | |
| Nominal Fluence | | | | | | | | | | | |
| BT-31 | 500 | 610 | $4 \times 10^{-4}$ | 1006.2 | 145.9 | 1185.2 | 171.9 | Specimen unloaded after 0.56% strain and cut for microscopy | | | |
| BT-58 | 550 | 232 | $4 \times 10^{-4}$ | 1153.0 | 167.2 | 1242.8 | 180.3 | 1452.4 | 210.7 | 5.4 | 5.6 |
| BT-07 | 600 | 232 | $4 \times 10^{-4}$ | 1165.7 | 169.1 | 1247.1 | 180.9 | 1461.8 | 212.0 | 5.4 | 5.4 |
| BT-71 | 500 | 232 | $4 \times 10^{-4}$ | 1104.0 | 160.1 | 1201.6 | 174.3 | 1482.6 | 207.8 | 6.1 | 6.1 |
| BT-74 | 600 | 710 | $4 \times 10^{-3}$ | 842.7 | 122.2 | 965.3 | 140.0 | 1057.2 | 153.3 | 2.7 | 5.7 |
| BT-77 | 600 | 710 | $4 \times 10^{-5}$ | 558.1 | 80.9 | 637.6 | 92.5 | 698.4 | 101.3 | 1.3 | 2.2 |

Although the invention has been shown in connection with certain specific embodiments, it will be readily apparent to those skilled in the art that various changes in method steps and compositional limits can be made to suit requirements without departing from the spirit and scope of the invention.

What is claimed is:

1. A method for heat treating an iron-nickel-chromium alloy consisting essentially of about 25% to 45% nickel, 10% to 16% chromium, 1.5% to 3% of an element selected from the group consisting of molybdenum and niobium, about 1% to 3% titanium, about 0.5% to 3.0% aluminum and the remainder substantially all iron; which method comprises the steps of heating the alloy to a temperature in the range of 1000° C. to 1100° C. for 30 seconds to 1 hour followed by a furnace-cool, cold-working the alloy 10% to 80%, heating the alloy to a temperature of about 750° C. to 800° C. for 4–15 hours followed by an air-cool, and then heating the alloy to a temperature in the range of 650° C. to 700° C. for 2–20 hours followed by an air-cool.

2. The method claim 1 wherein the alloy is initially heated to a temperature in the range of 1025° C. to 1075° C. for 2–5 minutes.

3. The method of claim 1 wherein said alloy is cold-worked by cold rolling 20% to 60%.

4. The method of claim 3 wherein said alloy is cold-rolled 30% to 50%.

5. The method of claim 1 wherein said alloy is in the form of a tube and is cold-worked by drawing the tube to produce a reduction of 15% to 35%.

6. The method of claim 5 wherein said reduction is within the range of 20% to 30%.

7. The method of claim 1 wherein, after cold-working, said alloy is heated to a temperature of about 775° C. for 8 hours followed by an air-cool.

8. The method of claim 1 wherein the method steps comprise heating to a temperature of 1025° C. to 1075° C. for 2–5 minutes followed by a furnace-cool, cold-working the alloy 20% to 60%, heating the alloy to a temperature of about 775° C. for 8 hours followed by an air-cool, and then heating the alloy to a temperature of 700° C. for 2 hours followed by an air-cool.

9. The method according to claim 1 wherein said element is molybdenum.

10. The method according to claim 1 or 9 further comprising the forming of a microstructure in said alloy having dislocations and a bimodal distribution of gamma prime precipitates.

11. The method according to claim 10 wherein said dislocations comprise interwoven dislocated cell structures which are pinned by said bimodal gamma prime precipitates.

* * * * *